US012311436B2

(12) United States Patent
Kreierhoff et al.

(10) Patent No.: US 12,311,436 B2
(45) Date of Patent: May 27, 2025

(54) SUBMERGED NOZZLE COMPRISING CONTINUOUS CIRCUMFERENTIAL WAVY RIBS

(71) Applicant: Vesuvius Group, S.A., Ghlin (BE)

(72) Inventors: Martin Kreierhoff, Ghlin (BE); Marcel Rave, Ghlin (BE); Johan Richaud, Ghlin (BE)

(73) Assignee: Vesuvius Group, S.A., Ghlin (BE)

( * ) Notice: Subject to any disclaimer, the term of this patent is extended or adjusted under 35 U.S.C. 154(b) by 0 days.

(21) Appl. No.: 18/712,471

(22) PCT Filed: Nov. 24, 2022

(86) PCT No.: PCT/EP2022/083144
§ 371 (c)(1),
(2) Date: May 22, 2024

(87) PCT Pub. No.: WO2023/094528
PCT Pub. Date: Jun. 1, 2023

(65) Prior Publication Data

US 2025/0018465 A1 Jan. 16, 2025

(30) Foreign Application Priority Data

Nov. 24, 2021 (EP) ..... 21210310

(51) Int. Cl.
*B22D 41/50* (2006.01)

(52) U.S. Cl.
CPC ..... *B22D 41/505* (2013.01)

(58) Field of Classification Search
CPC ..... B22D 41/50; B22D 41/505; B22D 41/54
See application file for complete search history.

(56) References Cited

FOREIGN PATENT DOCUMENTS

| | | | |
|---|---|---|---|
| CN | 207127252 | U | 3/2018 |
| FR | 2716301 | A1 | 8/1995 |
| FR | 2763011 | A1 | 11/1998 |
| JP | S57115953 | A | 7/1982 |
| JP | S6397344 | A | 4/1988 |
| JP | 4564774 | B2 * | 10/2010 |

(Continued)

OTHER PUBLICATIONS

International Search Report for PCT/EP2022/083144, dated Feb. 6, 2023.

*Primary Examiner* — Kevin E Yoon
(74) *Attorney, Agent, or Firm* — MaxGoLaw PLLC

(57) ABSTRACT

A submerged nozzle for casting molten metal into a mould, is provided that includes an erosion resistant sleeve (2) made of a material resistant to erosion provided over a tubular portion and extending along a longitudinal axis (Z). The erosion resistant sleeve includes at least one annular protrusion (2*p*), extending radially outwards beyond a recessed portion (2*r*) of the erosion resistant sleeve over the whole circumference of the erosion resistant sleeve (2), the at least one annular protrusion (2*p*) follows a periodic wavy trajectory oscillating between one or more tip-points situated closest to the first end and a corresponding number of one or more valley-points situated closest to the second end, the periodic wavy trajectory being defined by an amplitude (A) greater than 5 mm and a periodicity (P) comprised between 1 and 20 tip to valley to tip periods per 2π rad.

20 Claims, 7 Drawing Sheets

(56) References Cited

FOREIGN PATENT DOCUMENTS

| | | | |
|---|---|---|---|
| KR | 20060101717 | A | 9/2006 |
| KR | 20120134451 | A | 12/2012 |
| KR | 20160060986 | A | 5/2016 |

* cited by examiner

P = 10, N = 5

SUBMERGED NOZZLE COMPRISING CONTINUOUS CIRCUMFERENTIAL WAVY RIBS

FIELD OF THE INVENTION

The present invention relates to a submerged nozzle for continuous casting of molten metal, including submerged entry nozzles (SEN), submerged entry shrouds (SES), monoblock tundish nozzle plate (MTNP), and the like, collectively referred to as submerged nozzles. The submerged nozzles according to various embodiments of the present invention are configured for being coupled to a molten metal container, such as a tundish a ladle, and the like.

BACKGROUND OF THE INVENTION

In continuous metal forming processes, metal melt is transferred from one metallurgical vessel to another, to a mould or to a tool. For example, a ladle is filled with metal melt out of a furnace and driven over a tundish to discharge the molten metal from the ladle through a ladle shroud into the tundish. The metal melt can then be cast through a pouring nozzle from a tundish outlet to a mould or tool for continuously forming slabs, billets, beams, thin slabs, and the like. To avoid contamination and oxidation of the metal melt, the nozzles guiding the flow from a container to another or to a mould or tool are submerged below the level of molten metal. Flow of metal melt out of the ladle into the tundish and out of the tundish into the mould or tool is driven by gravity. The flow rate of metal melt can be controlled by sliding gates in fluid communication with an outlet of the ladle and tundish. A ladle sliding gate can be used to control the flow rate out of the ladle and even interrupt the flow at a sealed position. Similarly, a tundish sliding gate can be used to control the flow rate out of the tundish and interrupt the flow in a sealed position. Often, the flow rate out of the tundish is controlled by a stopper instead of a sliding gate.

A mould flux is a synthetic slag constituted by a complex mixture of oxides, minerals and carbonaceous materials applied at the level of the meniscus in a mould or tool (i.e., at the surface of the liquid metal) which ensures various functions, including, thermal insulation, prevention of reoxidation, entrapment of inclusions, and the like. Mould fluxes can have a variety of compositions, but usually comprise a selection of one or more of silica, calcia, sodium oxide, alumina, and magnesia. By their compositions, mould fluxes are generally more corrosive to the refractory materials forming the submerged nozzles than the liquid metal itself. In continuation, the terms "slag" and "mould flux" are used interchangeably.

The continuous casting process into a mould is a very complex one which involves many variables including casting speed, mould oscillation characteristics, steel grade, mould dimensions, all of which affect the metal flow conditions out of the submerged nozzle into the mould. As illustrated in FIG. 1, the liquid metal flowing out of the outlets of a submerged nozzle follow a complex flow pattern with vortices being formed as the metal rapidly flowing out of the nozzle hits the walls of the mould. A portion of the molten metal (21) reaching the cold walls of the mould (11) forms a shell (21*s*) of frozen metal. A further portion of the liquid metal flow is driven upwards reaching the slag or mould flux (22) comprising a mould powder (22*p*) and a molten mould powder (22*m*). This upwards flow causes some of the mould flux (both mould powder and molten mould powder) to be entrapped and driven down again, along the outer wall of the submerged nozzle at high velocity creating substantial friction forces on the outer wall of the submerged nozzle. The collisions of flows coming from different directions against the submerged nozzle can cause vortices. On top of the corrosive action discussed supra of the mould flux (22) on the outer wall of the submerged nozzle, these vortices add a friction erosion of the same outer wall, thus increasing the erosion rate of the outer wall of the submerged nozzle. In continuation, the term "erosion" is used to encompass any loss or degradation of material of the submerged nozzle outer wall caused by any one of friction, corrosion, and the like. In continuation, the term "corrosion" is the process of chemical or electrochemical erosion of a material that produces a deterioration of the material and its properties.

For the foregoing reasons, an erosion resistant sleeve made of a material more resistant to corrosion than the refractory material forming the tubular body of the submerged nozzle is often provided over the tubular body, extending over a section of the tubular body corresponding to the position of the slag. Erosion resistant sleeves are well known in the art and examples thereof are described, e.g., in KR20120134451 describing different types of erosion resistant sleeves, in KR20060101717 describing an erosion resistant sleeve which can be screwed onto the tubular portion of the submerged nozzle, in KR20160060986 describing compositions of such erosion resistant sleeves, and the like.

FR27163011 describes a movable erosion resistant sleeve provided with an inner thread configured for engaging a mating outer thread in the tubular portion of the submerged nozzle. The position of the erosion resistant sleeve can thus be varied along the axis of the tubular portion. JPS57115953 describes an erosion resistant sleeve made of two half-shells which can be clamped over the tubular portion of the submerged nozzle and held in place by a wire covered by an amorphous refractory. CN207127252U describes an erosion resistant sleeve comprising a protrusion extending radially and around the tubular portion of the submerged nozzle. The protrusion is symmetrical with respect to a plane normal to a longitudinal axis of the tubular portion.

To date, the solutions proposed for decreasing the erosion rate mainly focus on finding materials more resistant to the aggressive environment of such systems. When the use of ever more resistant materials for the erosion resistant sleeve is beneficial to the service life of submerged nozzles, there is no solution proposed in the art for reducing the magnitude of the friction forces onto these materials forming the erosion resistant sleeve. There is a need for such a solution, allowing extending even further the service life of a submerged nozzle provided with an erosion resistant sleeve made of any erosion resistant material.

SUMMARY OF THE INVENTION

The submerged nozzles according to various embodiments of the present invention have an enhanced resistance to erosion due to, on the one hand,

- an erosion resistant sleeve surrounding the nozzle where the erosion is strongest and, on the other hand,
- at least one annular protrusion encircling the erosion resistant sleeve according to a specific pattern, to reduce the amplitude of the molten metal vortices responsible for most of the erosion.

The objectives of the present invention include an improved submerged nozzle for casting molten metal into a mould. According to at least one embodiment, the submerged nozzle comprises a tubular portion and an erosion resistant sleeve.

The tubular portion is made of a first material and extends along a longitudinal axis (Z) over a tube length (L1) between a first end and a second end. The tubular portion comprises an inner bore (1*b*) extending along the longitudinal axis (Z) from an inlet axially opening at or adjacent to the first end to at least one outlet opening at or adjacent to the second end.

The erosion resistant sleeve is made of a second material different from, and more resistant to erosion and corrosion than the first material. In other words, the second material is selected such that it is more resistant to erosion than the first material; similarly, the second material is selected such that it is more resistant to corrosion than the first material. In one embodiment, the second material comprises, for e.g., zirconia. The erosion resistant sleeve is provided over the tubular portion and extends circumferentially over a whole circumference of (e.g., circumscribes) the tubular portion, extending along the longitudinal axis (Z) over a sleeve length (L2) lower than the tube length (L1) (i.e., L2<L1). The erosion resistant sleeve comprises a recessed portion of thinnest cross-section defined by a major axis (DM) and a minor axis (dm), wherein a ratio (dm/DM) of the minor axis to the major axis is comprised between 0.7 to 1.0.

According to at least one embodiment, a submerged nozzle for casting molten metal into a mould comprises,

- a tubular portion (1) made of a first material, wherein the tubular portion,
  - extends along a longitudinal axis (Z) over a tube length (L1) between a first end and a second end of the submerged nozzle,
  - comprises an inner bore (1*b*) extending along the longitudinal axis (Z) from an inlet (1*i*) axially opening at or adjacent to the first end to at least one outlet (1*o*) opening at or adjacent to the second end,
- an erosion resistant sleeve (2) made of a second material different from, and more resistant to erosion than, the first material, wherein the erosion resistant sleeve,
  - circumscribes a whole circumference of the tubular portion, and extends along the longitudinal axis (Z) over a sleeve length (L2) lower than the tube length (L1) (i.e., L2<L1),
  - comprises a recessed portion (2*r*) of a thinnest cross-section defined by a major axis (DM) and a minor axis (dm), wherein a ratio (dm/DM) of the minor axis to the major axis is between 0.7 to 1.0, In at least one embodiment, the erosion resistant sleeve comprises at least one annular protrusion (2*p*), extending radially outwards beyond the recessed portion (2*r*) by a protruding distance (a) over a whole of the circumference of the erosion resistant sleeve (2), wherein the at least one annular protrusion (2*p*) follows a trajectory oscillating between one or more tip-points situated closest to the first end and a corresponding number of one or more valley-points situated closest to the second end. The at least one annular protrusion is obviously made of the second material and is preferably integral with the erosion resistant sleeve. The at least one annular protrusion preferably forms a closed loop around the tubular portion of the submerged nozzle of the present invention. The at least one annular protrusion is located on the external surface of the erosion resistant sleeve. It is designed to be in direct contact with the molten metal.

The present invention provides the erosion resistant sleeve with at least one annular protrusion (2*p*), extending radially outwards beyond the recessed portion by a protruding distance (a) over the whole circumference of the erosion resistant sleeve. The at least one annular protrusion (2*p*) follows a periodic wavy trajectory oscillating between one or more tip-points situated closest to the first end and a corresponding number of one or more valley-points situated closest to the second end. The periodic wavy trajectory is defined by an amplitude (A) and a periodicity (P). In closed loop annular protrusions, there is a same number of tip-points as of valley points. In other words, to each tip-point corresponds one and only one valley point. The distance separating a tip-point from a valley point measured along the longitudinal axis (Z) defines the amplitude (A) of the trajectory followed by the annular protrusion. The number of tip-points (or of valley points) per revolution around the tubular portion defines the periodicity (P) of the trajectory followed by the annular protrusion.

The amplitude (A) of the periodic wavy trajectory is greater than 5 mm (i.e., A>5 mm) measured along the longitudinal axis (Z) between adjacent tip-points and valley points. The periodicity (P) of the periodic wavy trajectory is defined as the number of tip-to-valley periods per $2\pi$ rad of circumference, and is comprised between 1 and 20 tip-to-valley-to tip periods per $2\pi$ rad (i.e., P=1 to 20), preferably the periodicity (P) is comprised between 2 and 5.

The periodic wavy trajectory can be in the form of a rounded wavy trajectory, preferably a sinusoidal trajectory, or is in the form of a chevron trajectory and wherein the amplitude (A) measured between adjacent tip-points and valley points of an annular protrusion is preferably constant for all adjacent tip-points and valley-points of the annular protrusion.

A submerged nozzle according to the present invention can comprise one, two, three, four, five, or more annular protrusions (2*p*) distributed along the longitudinal axis (Z). According to some embodiments, wherein in a case of two or more protrusions, the protrusions do not contact with one another, and are preferably identical to each other, and more preferably parallel to one another.

A cross-section along a plane comprising the longitudinal axis (Z) of the one or more annular protrusions can be selected among, rounded, trapezoidal, square, or triangular.

The annular protrusion protrudes radially from the recessed portion by the protruding distance (a) such that a ratio (a/Dra) of the protruding distance (a) of the annular protrusion to an average recess diameter (Dra) of the recessed portion can be comprised between 1 and 30% (i.e., a/Dra=1-30%), preferably between 5 and 20%, The average recess diameter (Dra) is defined as the average of the major and minor axes of the recessed portion (2*r*) (i.e., Dra=½(DM+dm)). For example, the annular protrusion can protrude radially from the recessed portion by a protruding distance (a) comprised between 5 and 50 mm (i.e., a=5-50 mm), preferably between 8 and 25 mm.

A length ratio (L2/L1) of the sleeve length (L2) to the tube length (L1) can be comprised between 10 and 50%, preferably between 20 and 40%. At least two annular protrusions are preferably distributed over the sleeve length (L2) of the erosion resistant sleeve. An amplitude ratio (A/L2) of the amplitude (A) to the sleeve length (L2) can be comprised between 2% and 100%, preferably between 5% and 50%.

The annular protrusion (2*p*) can have a width (b) measured along the longitudinal axis (Z) comprised between 5 and 50 mm, preferably between 10 and 40 mm, more preferably, the width (b) is 25±10 mm.

The present invention proposes a specific design of the erosion resistant sleeve allowing reducing the velocity of the metal flowing along the wall of the submerged nozzle and reducing the friction forces accordingly. This has the advantage to reduce the erosion rate and thus to further increase the service life of submerged nozzles. These and other advantages of the present invention are explained more in detail in the following sections.

The present invention also concerns a process for reducing erosion of a submerged nozzle upon continuous casting of molten metal into a mould. The process comprises coupling an inlet of a submerged nozzle to a molten metal container, with an outlet engaged in a mould, and casting metal from the molten metal container into the mould through a bore of the submerged nozzle. The submerged nozzle of the present process is as described supra, with at least one annular protrusion being submerged below a level of slag in the mould. This way, the formation of vortices mainly responsible for erosion cannot grow continuously.

The present invention also concerns a casting installation comprising:

- a molten metal container containing molten metal and comprising a casting outlet,
- a mould or a tundish provided below the casting outlet along the longitudinal axis (Z),
- a submerged nozzle comprising an inner bore extending along the longitudinal axis (Z) from an inlet axially opening at or adjacent to a first end to at least one outlet opening at or adjacent to a second end,
- wherein the submerged nozzle is coupled to the molten metal container such that the inlet of the submerged nozzle is in fluid communication with the casting outlet, and such that the outlet of the submerged nozzle is inside the mould or tundish.

The casting installation of the present invention is characterized in that, the submerged nozzle is described supra.

BRIEF DESCRIPTION OF THE DRAWINGS

FIG. 4(*d*) shows a partial cut view of a nozzle showing two annular protrusions, according to various embodiments of the invention.

DETAILED DESCRIPTION

Figure 2A:
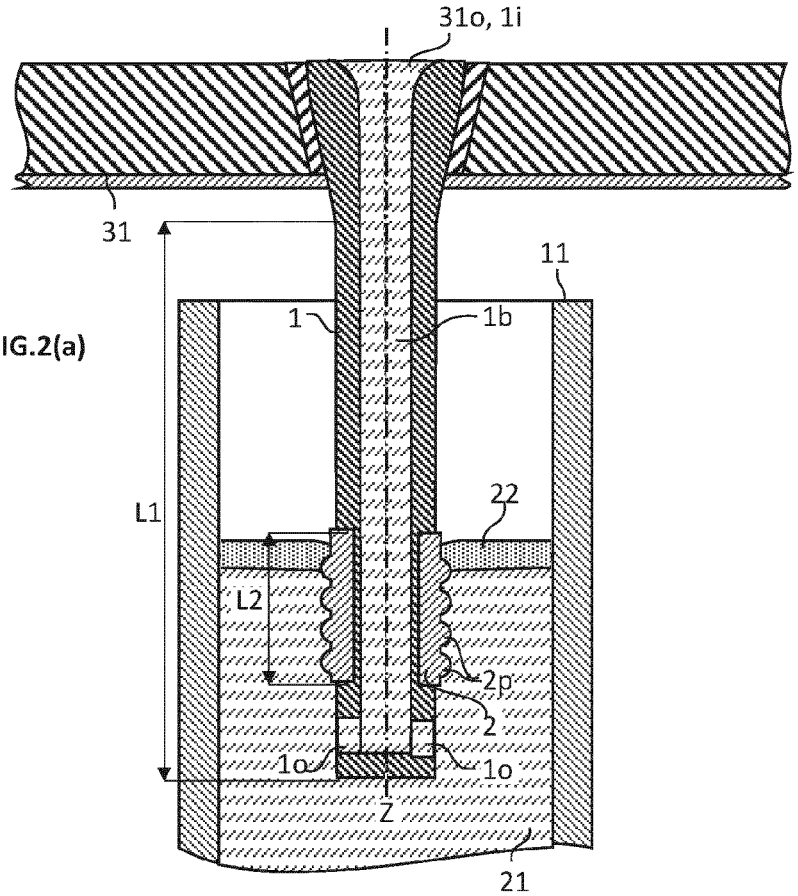
FIG. 2 shows a side cut view of a submerged nozzle according to the present invention, 2(*a*), a submerged entry nozzle (SEN) dispensing liquid metal into a mould, and 2(*b*), a monoblock tundish nozzle plate (MTNP), according to various embodiments of the invention.
Figure 2B:
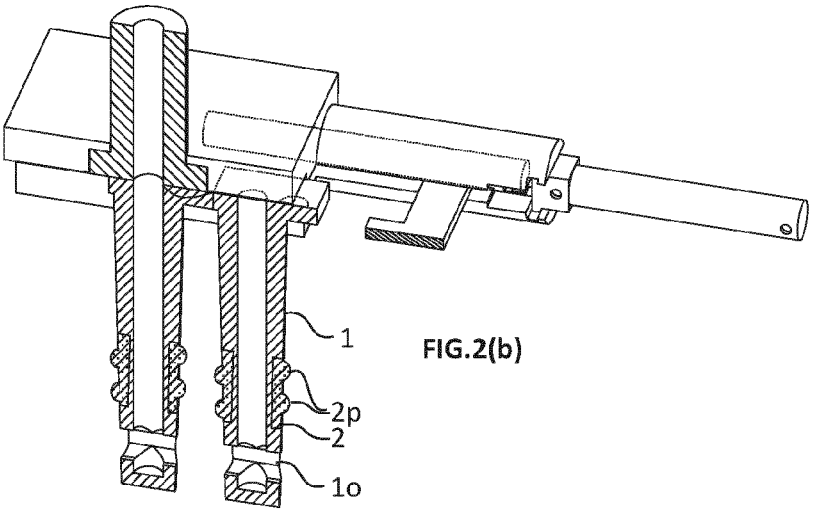
Figure 3A:
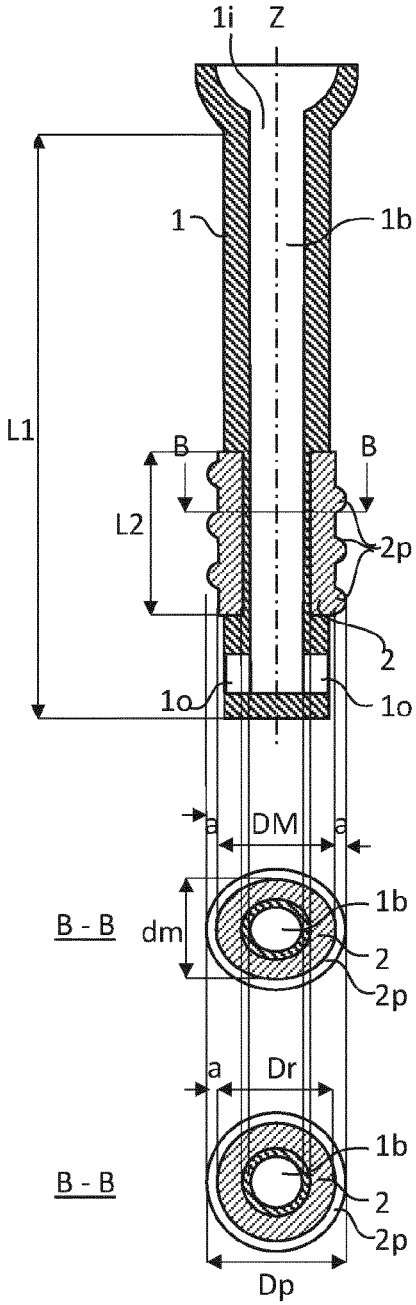
FIGS. 3(*a*) & 3(*b*) show side cut views and cross-cut views (A-A) and (B-B) of two embodiments of submerged nozzles, according to various embodiments of the invention.
Figure 3B:
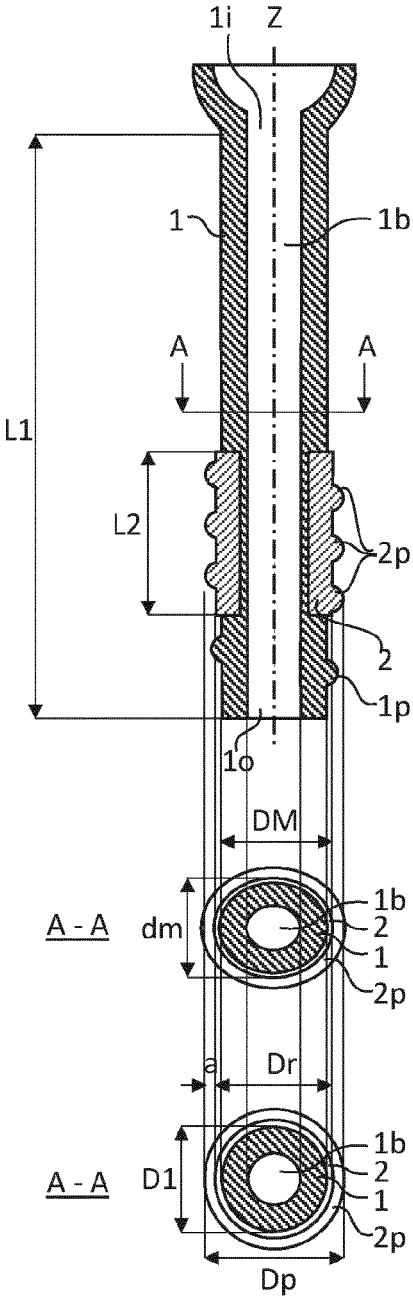
Figure 4A:
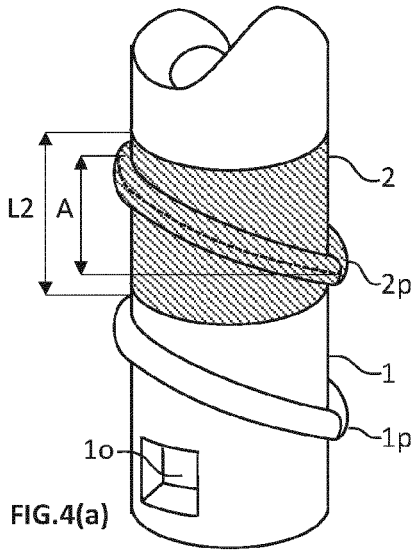
FIG. 4(*a*)-4(*c*) show submerged nozzles comprising different numbers (N) of annular protrusions of different periodicities (P), amplitudes (A) in erosion resistant sleeves of length (L2) measured along the longitudinal axis (Z)
Figure 4C:
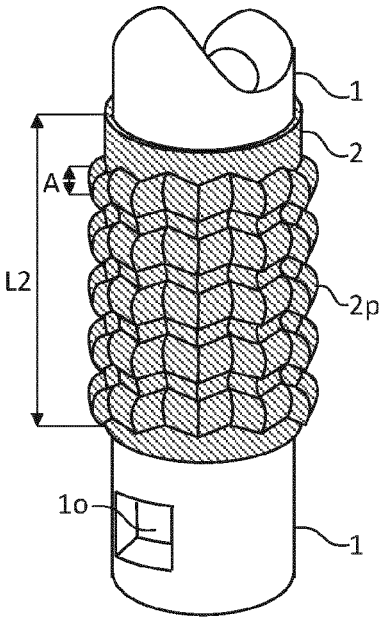
Figure 4B:
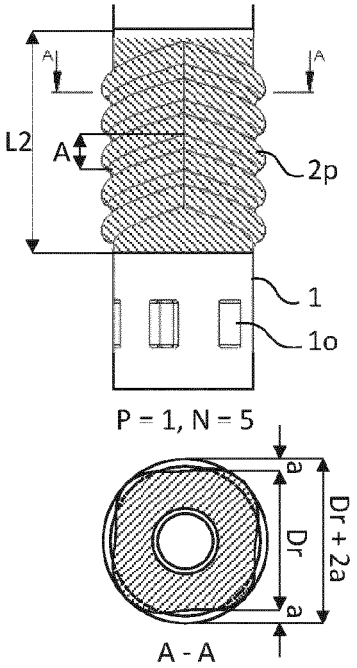
Figure 4D:
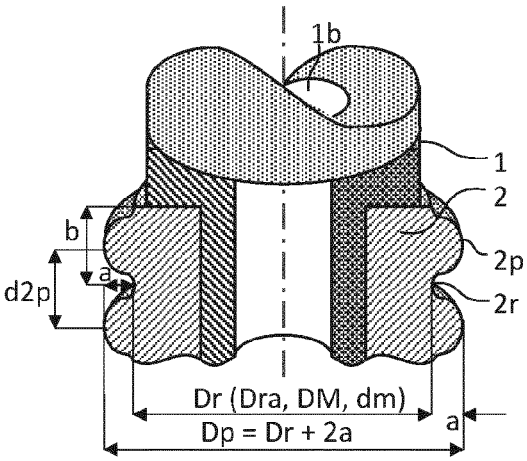

As illustrated in FIG. 2, a submerged nozzle according to the present invention is configured for casting molten metal (21) into a mould (11). It can also be used for filling a tundish from a ladle. The expression "submerged nozzle" is used herein to collectively refer to any nozzle configured for dispensing liquid metal through one or more outlets, wherein the one or more outlets are submerged below the level of the liquid metal. This includes among others, submerged entry nozzles (SEN) (cf. FIG. 2(*a*)), submerged entry shrouds (SES), monoblock tundish nozzle plate (MTNP) (cf. FIG. 2(*b*)), and the like. As illustrated in FIGS. 3(*a*) and 3(*b*), the submerged nozzle comprises a tubular portion (1) and an erosion resistant sleeve (2) provided over the tubular portion (1).

The tubular portion (1) is made of a first material, typically a refractory ceramic material which is thermally stable and permeable to gases being released from the flowing metal. The materials used for the tubular portion (1) of submerged nozzles are well known in the art and can include, e.g., $Al_2O_3$—C-based refractory materials. Other materials can include silicon dioxide, spinel and the like.

The tubular portion extends along a longitudinal axis (Z) over a tube length (L1) between a first end and a second end. It comprises an inner bore (1*b*) extending along the longitudinal axis (Z) from an inlet (1*i*) axially opening at or adjacent to the first end to at least one outlet (1*o*) opening at or adjacent to the second end. One outlet (1*o*) can open at the second end coaxially with the longitudinal axis (Z) as shown in FIG. 3(*b*) and/or one or more outlets (1*o*) can open radially as shown in FIGS. 2, 3(*a*), and 4(*a*) to 4(*c*). The invention is not restricted to any particular configuration of the one or more outlets (1*o*).

The erosion resistant sleeve (2) is made of a second material different from, and more resistant to erosion and corrosion than the first material. Second materials are well known in the art and are described e.g., in JPS6397344, KR1020160060986, and the like. The second material typically comprises zirconia, sometimes with other materials such as graphite, SiC, and the like. The erosion resistant sleeve offers a higher resistance, on the one hand, to the corrosive action of the mould flux (or slag) (22) and, to a lesser extent, of the molten metal (21) and, on the other hand, to the erosive action of vortices of liquid metal, sometimes mixed with entrapped mould flux (22) formed at the surface of the walls of the submerged nozzles, and creating frictional forces eventually leading to a degradation of the submerged nozzles. The second material can include another material similar to zirconia as long as the erosion resistance of the second material is higher than the erosion resistance of the first material, as the person skilled in the art readily understands.

The erosion resistant sleeve (2) is provided over the tubular portion (1) and extends circumferentially over a whole circumference of the tubular portion. For example, the erosion resistant sleeve circumscribes a whole circumference of the tubular portion. It also extends along the longitudinal axis (Z) over a sleeve length (L2) lower than the tube length (L1) (i.e., L2<L1). KR2006101717 describes an erosion resistant sleeve which can reversibly be screwed over the tubular portion of a submerged nozzle. The erosion resistant sleeve (2) can be flush with the tubular portion (1). It can be recessed relative to the tubular portion (1) but the erosion resistant sleeve preferably protrudes out of the tubular portion (1) forming a little step of the order of 1 to 5 mm, preferably of 2 to 3 mm.

The present invention focuses on submerged nozzles (and corresponding erosion resistant sleeves (2)) having a substantially circular cross-section or an elliptic cross-section of aspect ratio (dm/DM) of a minor axis (dm) to a major axis (DM) comprised between 0.7 to 1.0. The erosion resistant sleeve (2) has a recessed portion (2*r*) of thinnest cross-section defined by the minor axis (dm) and the major axis (DM). For circular cross-sections, wherein DM=dm, it was decided to refer to a diameter Dr=DM=dm, to simplify the reading. This is illustrated in the two cross-sectional cut views under each of FIGS. 3(*a*) and 3(*b*), showing an elliptic cross-section (top figures) of major and minor axes (DM, dm) and a circular cross-section (bottom figures) of diameter (Dr).

A further advantageous aspect of the present invention is that the erosion resistant sleeve comprises at least one annular protrusion (2*p*), forming a rib extending radially outwards beyond the recessed portion (2*r*) by a protruding distance (a) over the whole circumference of the erosion resistant sleeve (2). The at least one annular protrusion (2*p*) follows a wavy trajectory around the erosion resistant sleeve oscillating between one or more tip-points situated closest to the first end and a corresponding number of one or more valley-points situated closest to the second end. In some embodiments, the wavy trajectory may be periodic. In some embodiments, the periodic wavy trajectory is a closed trajectory which can be defined by an amplitude (A) and a periodicity (P).

The amplitude (A) is the distance measured along the longitudinal axis (Z) separating a tip point to a valley point. If a period comprises several valley points and tip points, the amplitude is defined as the largest distance separating a valley point from an adjacent tip point within said period. The amplitude of the annular protrusion according to the present invention is greater than 5 mm (i.e., A>5 mm) measured along the longitudinal axis (Z) between adjacent tip-points and valley points. It is preferably comprised between 10 mm and 450 mm, more preferably between 15 mm and 150 mm, more preferably between 20 mm and 100 mm, most preferably between 25 mm and 75 mm.

The periodicity (P) is defined as the number of tip-to-valley periods per 2π rad of circumference. The periodicity of an annular protrusion according to the present invention is comprised between 1 and 20 tip-to-valley-to tip periods per 2π rad (i.e., P=1 to 20), preferably the periodicity (P) is comprised between 2 and 10, more preferably between 3 and 5. FIGS. 4(*a*), 5(*a*)&5(*b*), and 7(*a*)&7(*b*) show annular protrusions (2*p*) of periodicity P=1. FIGS. 4(*b*), 6(*a*) &6(*b*), and 8(*a*)&8(*b*) show annular protrusions (2*p*) of periodicity P=2; FIG. 4(*c*) shows an annular protrusion of periodicity P=10. Even though a periodicity, P=1, does not define a periodic wavy trajectory over 2π rad, as can be seen in the unfolded representations of FIGS. 5(*b*), 7(*b*), and 9(*b*), it is considered herein as defining a periodic wavy trajectory over several (n) revolutions (n 2π rad). Preferably, in case of a periodicity P=1, the wavy trajectory must comprise at least one axis of symmetry parallel to the longitudinal axis (Z) to be considered as being periodic.

Figure 5A:
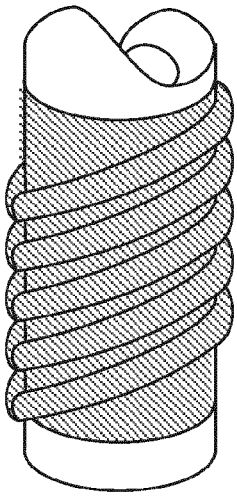
FIGS. 5(*a*) & 5(*b*) show an embodiment of submerged nozzle comprising N=5 identical annular protrusions of periodicity, P=1; 5(*a*) shows a perspective view, 5(*b*) shows an unfolded circumference of the erosion resistant sleeve, according to at least one embodiment of the invention. The wavy trajectories of the annular protrusions define chevrons, according to at least one embodiment of the invention.
Figure 5B:
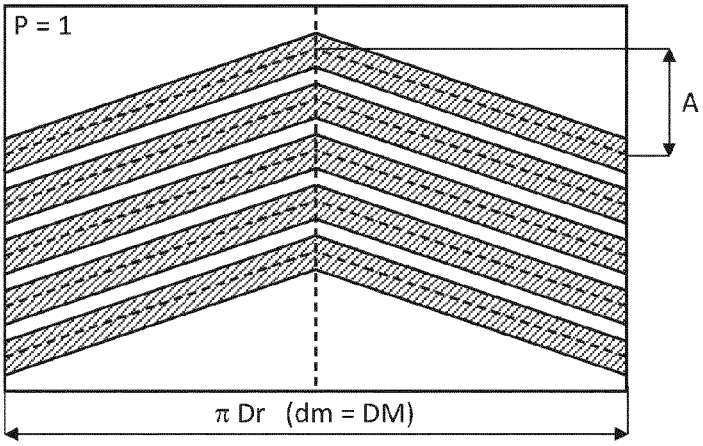
Figure 6A:
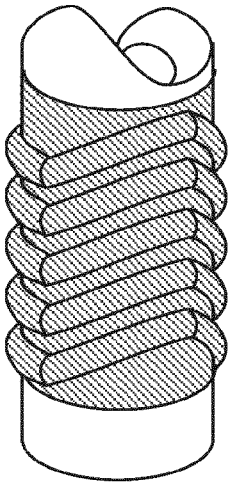
FIGS. 6(*a*) & 6(*b*) show an embodiment of submerged nozzle comprising N=5 identical annular protrusions of periodicity, P=2; 6(*a*) shows perspective view, 6(*b*) shows an unfolded circumference of the erosion resistant sleeve, according to at least one embodiment of the invention. The wavy trajectories of the annular protrusions define chevrons, according to at least one embodiment of the invention.
Figure 6B:
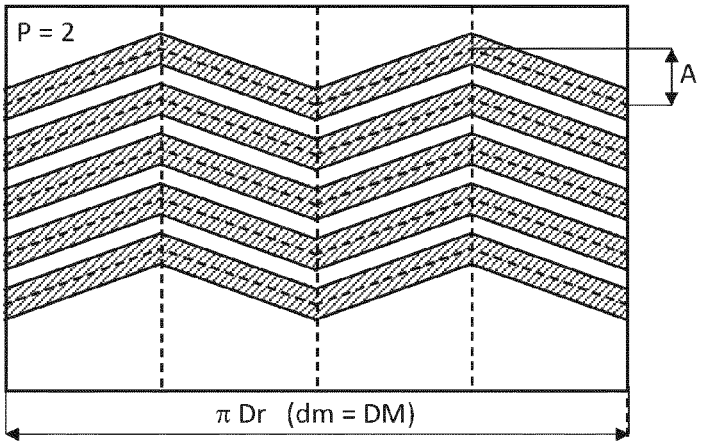
Figure 7A:
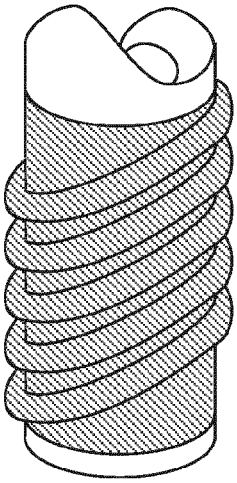
FIGS. 7(*a*) & 7(*b*) show an embodiment of submerged nozzle comprising N=5 identical annular protrusions of periodicity, P=1; 7(*a*) shows a perspective view, 7(*b*) shows an unfolded circumference of the erosion resistant sleeve, according to at least one embodiment of the invention. The wavy trajectories of the annular protrusions are rounded (sinusoidal).
Figure 7B:
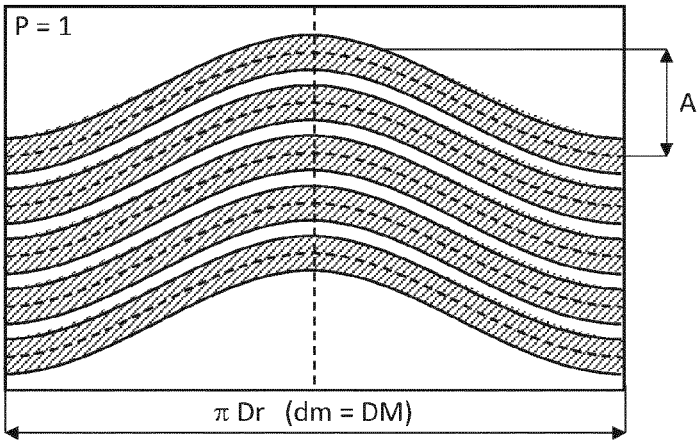
Figure 8A:
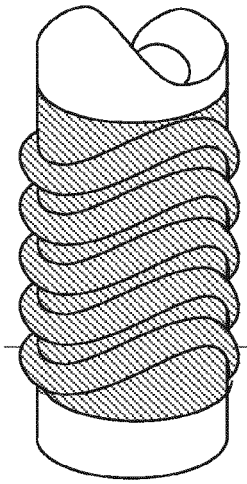
FIGS. 8(*a*) & 8(*b*) show an embodiment of submerged nozzle comprising N=5 identical annular protrusions of periodicity, P=2; 8(*a*) shows a perspective view, 8(*b*) shows an unfolded circumference of the erosion resistant sleeve, according to at least one embodiment of the invention. The wavy trajectories of the annular protrusions are rounded (sinusoidal), according to at least one embodiment of the invention.
Figure 8B:
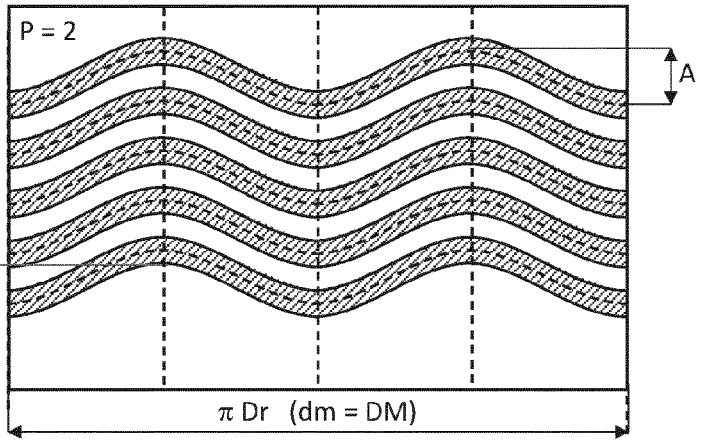

Regarding the geometry of an annular protrusion, each of the one or more annular protrusions defines a closed-loop, periodic wavy trajectory. As illustrated in FIGS. 7(*a*), 7(*b*) and 8(*a*), 8(*b*), in a first embodiment, the periodic wavy trajectory can be in the form of a rounded wavy trajectory. For example, the periodic wavy trajectory can be a sinusoidal trajectory. In an alternative embodiment, illustrated in FIGS. 5(*a*), 5(*b*) and 6(*a*), 6(*b*), the periodic wavy trajectory can be in the form of chevrons. In a preferred embodiment, the amplitude (A) measured between adjacent tip-points and valley points of an annular protrusion is constant for all adjacent tip-points and valley-points of the annular protrusion. As mentioned supra, in case of a periodicity of P=1, it is preferred to have at least one axis of symmetry parallel to the longitudinal axis (Z) at an angle π rad, as shown in FIGS. 5(*a*), 5(*b*) and 7(*a*), 7(*b*). A period P=1, 2, 3, 4, or 5 is preferred for each revolution (2π rad).

As shown in FIGS. 4(*d*), 10(*a*) to 10(*e*), a cross-section along a plane comprising the longitudinal axis (Z) of the one or more annular protrusions (2*p*) can be selected among, rounded, trapezoidal, square, or triangular. Other geometries can be envisaged too. The protruding distance (a) of an annular protrusion (2*p*) is defined for each azimuthal angle about the longitudinal axis (Z) as the largest distance separating the recessed portion (2*r*) directly adjacent to the annular protrusion (2*p*) and a tip portion furthest away from said recessed portion. If the annular protrusion (2*p*) defines a linear ridge (e.g., with a rounded or triangular cross-section as illustrated in FIGS. 10(*a*) and 10(*e*)), then the tip portion follows the ridge, and defines the wavy geometry of the annular protrusion (2*p*). If the cross-section of the annular protrusions (2) defines a flat plateau parallel to the longitudinal axis as illustrated in FIGS. 10(*b*) to 10(*d*), the tip portion is the plateau itself, and the wavy geometry of the annular protrusion (2*p*) follows the line comprised in the plateau which is equidistant to the edges of the plateau.

In a preferred embodiment, the annular protrusion (2*p*) protrudes radially from the recessed portion (2*r*) directly adjacent thereto by the protruding distance (a) such that a ratio (a/Dra) of the protruding distance (a) of the annular protrusion (2*p*) to an average recess diameter (Dra) of the recessed portion (2*r*) is comprised between 1 and 30% (i.e., a/Dra=1-30%), preferably between 5 and 20%. The average recess diameter (Dra) is defined as the average of the major and minor axes of the recessed portion (2*r*) (i.e., Dra=½ (DM+dm)). In case of a submerged nozzle of circular cross-section, Dra=Dr. The annular protrusion (2*p*) can protrude radially from the recessed portion (2*r*) directly adjacent thereto by a protruding distance (a) comprised between 5 mm and 50 mm (i.e., a=5-50 mm), preferably between 8 mm and 25 mm. Note that the protruding distance (a) is not necessarily constant and can vary with the azimuthal angle. For example, moulds generally have a broad side and a narrow side, and in some cases the protrusion distance (a) can be lower at the positions facing the broad sides, to leave enough room between the broad sides and the annular protrusions (2) for metal to freely flow therebetween. Alternatively, the protrusion distance (a) can be constant over the whole circumference of the annular protrusion (2*p*).

Referring to FIGS. 4(*a*) to 4(*c*), an amplitude ratio (A/L2) of the amplitude (A) to the sleeve length (L2) can be comprised between 2% and 100%, preferably between 5% and 50%. If the submerged nozzle comprises a single annular protrusion (2*p*) the amplitude can span over the whole of the foregoing ranges. If the submerged nozzle comprises more than one annular protrusion (2*p*) the amplitude ratio is preferably below 40% (i.e., A/L2<40%). A length ratio (L2/L1) of the sleeve length (L2) to the tube length (L1) can be comprised between 10 and 50%, preferably between 20 and 40%.

As illustrated in FIGS. 4(*d*), 10(*a*) to 10(*e*), a width (b) measured along the longitudinal axis (Z) of an annular protrusion (2*p*) can be comprised between 5 and 50 mm, preferably between 10 and 40 mm, more preferably, the width (b) is 25±10 mm. The width (b) is defined as the distance (b) measured along the longitudinal axis (Z) separating two recessed portions (2*r*) flanking each side of the annular protrusion. This applies also in case the two recessed portions (2*r*) flanking each side of the annular protrusion do not have a same diameter. as shown e.g., in FIG. 10(*d*). In a preferred embodiment, the width (b) of an annular protrusion (2*p*) is constant over the whole circumference thereof. Alternatively, the width (b) of an annular protrusion (2*p*) can vary with the azimuthal angle about the longitudinal axis (Z).

As mentioned supra, the second material can be any erosion resistant material known in the art, such as described e.g., in JPS6397344, KR1020160060986, and the like. The second material typically comprises zirconia, pure or with other materials such as graphite, SiC, and the like.

Various embodiments have more than one annular protrusions (2*p*). When FIG. 4(*a*) shows a submerged nozzle with a single annular protrusion (2*p*) in the erosion resistant sleeve (2), the submerged nozzle can comprise a number (N≥1) of annular protrusions larger than one, as shown in e.g., FIGS. 4(*b*) to 4(*d*), 5(*a*)&5(*b*) to 9(*a*)&9(*b*). The number (N) of annular protrusions can be 2, 3, 4, 5, 6 or even higher. The more than one annular protrusions (2*p*) are distributed without contact with one another along the length (L2) of the erosion resistant sleeve (2). In a preferred embodiment illustrated e.g., in FIGS. 5(*a*)&5(*b*) to 8(*a*)&8(*b*) at least two annular protrusions (2*p*), preferably all the annular protrusions are identical to each other. In a most preferred embodiment, the identical annular protrusions are arranged parallel to one another. A distance (d2p) separating a tip-point of a first annular protrusion from a tip-point of a second annular protrusion adjacent to the first one can be constant over the whole circumferences of the two annular protrusions (2*p*). All the annular protrusions (2*p*) of a submerged nozzle are preferably separated from one another by a same distance (d2*p*).

Figure 9A:
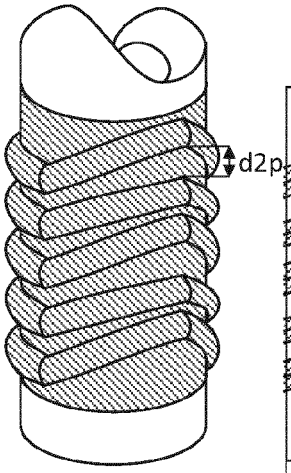
FIGS. 9(*a*) & 9(*b*) show an embodiment of submerged nozzle comprising N=5 annular protrusions having different amplitudes (A) and of periodicity, P=2; 9(*a*) shows perspective view, 9(*b*) shows an unfolded circumference of the erosion resistant sleeve, according to at least one embodiment of the invention. The wavy trajectories of the annular protrusions define chevrons, according to at least one embodiment of the invention.
Figure 9B:
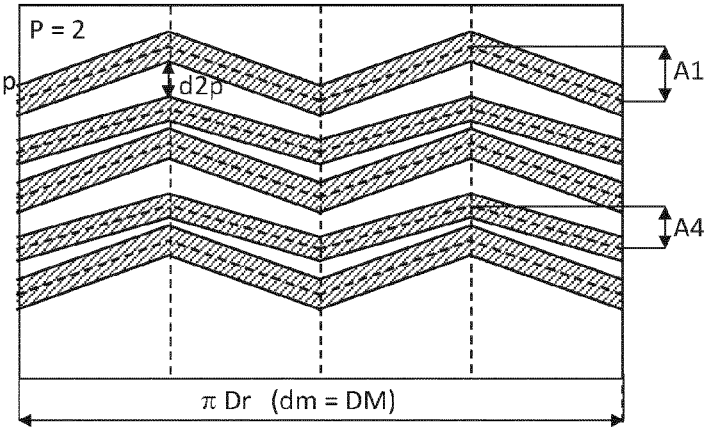
Figure 10A:
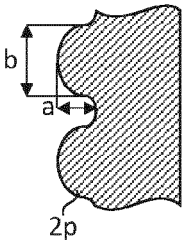
FIG. 10(*a*)-10(*e*) show various embodiments of cross-sectional geometries of the annular protrusions.
Figure 10B:
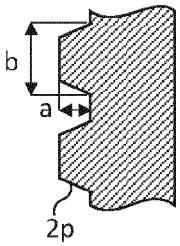
Figure 10C:
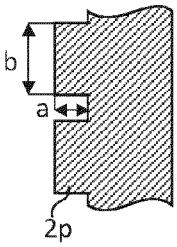
Figure 10D:
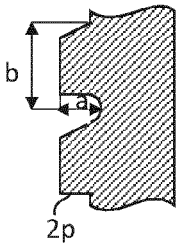
Figure 10E:
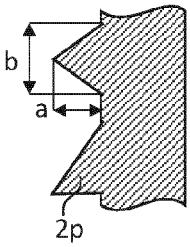

Alternatively, the more than one annular protrusions are not identical and not necessarily parallel to one another (cf. FIGS. 9(*a*)&9(*b*)). The distance (d2*p*) separating two adjacent annular protrusions can vary with the azimuthal angle relative to the longitudinal axis (Z). All annular protrusions can be separated by different distances (d2*p*) from one another.

With a length ratio (L2/L1) of the sleeve length (L2) to the tube length (L1) comprised between 10 and 50%, preferably between 20 and 40%, at least two annular protrusions (2*p*) can be distributed over the sleeve length (L2) of the erosion resistant sleeve (2). The more than one annular protrusions (2*p*) are preferably distributed over between 50% and 100% of the sleeve length (L2), preferably between 80% and 95%.

A shown in FIGS. 3(*b*) and 4(*a*), additionally to the one or more annular protrusions (2*p*) of the erosion resistant sleeve (2) the submerged nozzle of the present invention can comprise one or more additional annular protrusions (1*p*) situated in a section of the tubular portion (1) comprised between the erosion resistant sleeve (2) and the one or more outlets (1*o*). The additional annular protrusions can have the same geometries as discussed with respect to the annular protrusions (2*p*) in the erosion resistant sleeve (2) and differ therefrom merely in the material, which is the same first material as used in the tubular portion (1). The additional protrusions (1*p*) can be identical, preferably parallel to the annular protrusions (2*p*) in the erosion resistant sleeve (2) or they can be different.

Process for reducing erosion in a submerged nozzle can involve the following steps. The present invention also concerns a process for reducing erosion of a submerged nozzle upon continuous casting of molten metal into a mould. The process comprises,

- coupling an inlet (1*i*) of a submerged nozzle to a molten metal container (31), with an outlet (1*o*) engaged in a mould (11),
- casting metal from the molten metal container into the mould through a bore (1*b*) of the submerged nozzle.

The submerged nozzle comprises an erosion resistant sleeve provided with at least one annular protrusion (2*p*) as discussed supra with at least one annular protrusion (2*p*) being submerged below a level of slag or mould flux (22) in the mould (11). The level of slag is referred to herein as the meniscus.

The level of the meniscus varies during a casting operation. It is preferred that at all time of a casting operation, a distance separating the meniscus from a first annular protrusion (2*p*) closest to the inlet be less than twice the average diameter (Dra) of the recessed portion (2*r*) closest to the inlet (i.e., distance <2 Dra), preferably less than Dra (i.e., distance<Dra), wherein Dra=(DM+dm)/2 in case of elliptic submerged nozzles, and Dra=Dr in case of circular submerged nozzles with DM=dm=Dr.

At least one annular protrusion (2*p*) is preferably completely immersed below the meniscus during the whole casting operation.

Casting installation can include the following aspects. The present invention also concerns a casting installation comprising: (1) a molten metal container (31) containing molten metal and comprising a casting outlet (31*o*), (2) a mould (11) or a second metal container provided below the casting outlet (31*o*) along the longitudinal axis (Z), and (3) a submerged nozzle comprising an inner bore (1*b*) extending along the longitudinal axis (Z) from an inlet (1*i*) axially opening at or adjacent to a first end to at least one outlet (1*o*) opening at or adjacent to a second end.

The submerged nozzle is coupled to the molten metal container such that the inlet (1*i*) of the submerged nozzle is in fluid communication with the casting outlet (31*o*), and such that the outlet (1*o*) of the submerged nozzle is inside the mould or second metal container, In the installation of the present invention, the submerged nozzle comprises an erosion resistant sleeve provided with at least one annular protrusion (2*p*) as discussed supra.

The molten metal container (31) is typically a tundish casting metal into the mould through the submerged nozzle of the present invention. The submerged nozzle can alternatively be coupled to a ladle dispensing liquid metal to a tundish through the submerged nozzle.

Figure 1:
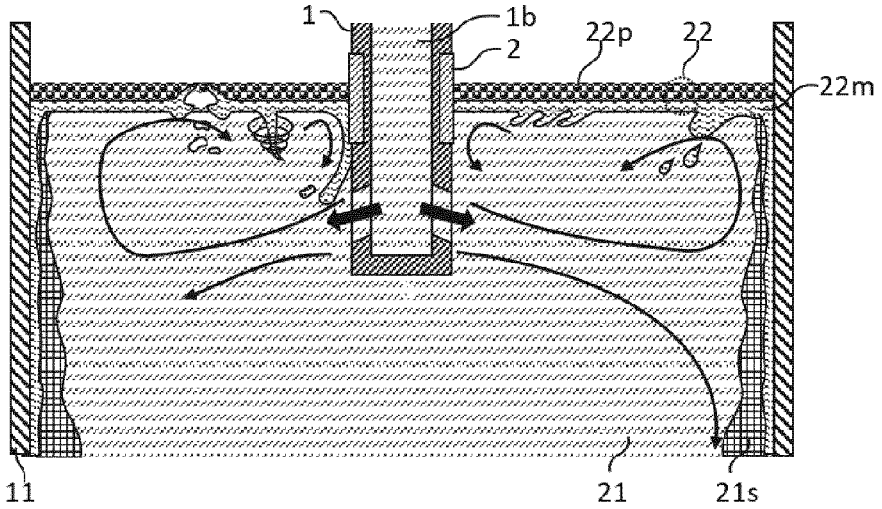
FIG.1 (Prior Art)
FIG. 1 shows a side cut view of a submerged nozzle of the prior art (P.A.), dispensing liquid metal into a mould with corresponding flow behaviours and slag entrapments.

The present invention can increase the service life of a submerged nozzle of given dimensions or, conversely, maintain a similar service life with thinner walls and less material used. The corrosion provoked by the mould flux contacting "statically" the walls of the submerged nozzle is slowed down by the use of an erosion resistant sleeve as is commonly known in the art. On the other hand, the present invention enhances substantially the resistance to erosion of the submerged nozzle compared with prior art submerged nozzles, by reducing substantially the friction forces caused by vortices of liquid metal and slag rubbing against the submerged nozzle. The most aggressive erosion is caused by vortices dragging flux powder from the surface of the slag down against the submerged nozzle (see FIG. 1). This erosion process is particularly marked at the interface between the erosion resistant sleeve (2) and tubular portion (1) closest to the outlets (1*o*) which is immerged. The annular protrusion (2*p*) of the submerged nozzle substantially reduce this interfacial erosion phenomenon.

Figure 11:
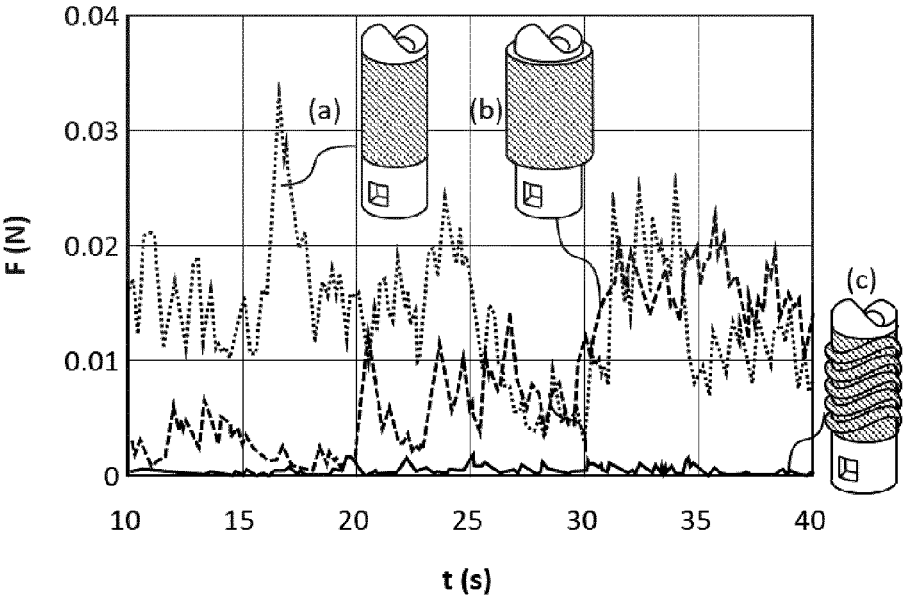
FIG. 11 shows a plot of friction forces measured at the surface of the erosion resistant sleeves of a first (a) and second (b) submerged nozzles of the prior art as compared to (c) a third submerged nozzle fabricated according to at least one embodiment of the present invention.

FIG. 11 plots the friction forces measured at the surface of the erosion resistant sleeves of a first (a) and second (b) submerged nozzles of the prior art and of (c) a third submerged nozzle according to the present invention. FIG. 11 shows the plot of frictional forces in regions of high powder concentrations. The tubular portions (1) of all submerged nozzles have of circular cross-section of identical diameter (D1). The erosion resistant sleeves of all submerged nozzles have a same sleeve length (L2) and made of a same second material. The erosion resistant sleeves of the first and second submerged nozzles (a) and (b) of the prior art have a smooth cylindrical surface of constant diameter, wherein; (1) the erosion resistant sleeve (2) of the first submerged nozzle (a) of the prior art has a sleeve diameter (Dr). equal to the diameter of the tubular portion (Dr=D1), and (2) the erosion resistant sleeve (2) of the second submerged nozzle (b) of the prior art has a sleeve diameter (Dp). equal to the diameter (D1) of the tubular portion+twice the protrusion distance (a) (Dp=D1+2a).

The erosion resistant sleeve (2) of the third submerged nozzle (c) of the present invention has N=5 identical annular protrusions (2*p*) of periodicity, P=2, distributed evenly over the sleeve length (L2). The annular protrusions are separated from one another by recessed portions (2*r*) of same diameter (Dr) as the tubular portion (1) (Dr=D1). The protrusions (2*p*) extend radially by a distance (a) beyond the recessed portions (2*r*), defining a protrusion diameter (Dp) equal to the sleeve diameter of the second submerged nozzle (b) of the prior art. The protrusion diameter (Dp) can be about 10 to 40% larger than the diameter (D1) of the tubular portion (i.e., Dp=110% D1 to 140% D1), preferably about 20 to 30% of D1 (i.e., Dp=120% D1 to 130% D1). The protrusion diameter (Dp) is not necessarily constant. On the one hand, the protrusion distance (a) can be constant, but the submerged nozzle has an elliptical cross-section, so that D1+2a varies in a same way as D1 varies. On the other hand, the protrusion distance (a) itself can vary with the azimuthal angle, so that even with a submerged nozzle having a circular cross-section of diameter, the protrusion diameter (Dp) can vary the same way the protrusion distance (a) varies and, for elliptical cross-sectioned nozzles, the same way the tubular portion diameter (D1) varies too.

The tests were carried out in a water model, with addition of powder floating at the meniscus to simulate the mould flux. Sensors were applied on the outer surface of the submerged nozzles and the friction forces were recorded as a function of time. FIG. 11 gives an example of the results measured as a function of time on the three submerged nozzles described supra. The following observations were made.

- With an average friction force of about 14 mN the first prior art submerged nozzle (cf. FIG. 11, curve (a), dotted line) having a smooth erosion resistant sleeve (2) flush with the tubular portion, records the highest level of frictional forces against the outer walls of the submerged nozzle, yielding the highest erosion rate of the three submerged nozzles tested.
- With a smooth erosion resistant sleeve (2) protruding out of the tubular portion by a protruding distance (a), the second prior art submerged nozzle (cf. FIG. 11, curve (b), dashed line) yielded a substantially lower average friction force of 9 mN than the first prior art submerged nozzle
- The submerged nozzle of the present invention (cf. FIG. 11, curve (c), solid line), with an erosion resistant sleeve (2) comprising N=5 annular protrusions (2*p*) separated from one another by recessed portions (2*r*) flush with the tubular portion, and protruding out of the recessed portions by a protruding distance (a) yielded a substantially lower average frictional friction of about 0.3 mN, i.e., about 30 times less than the second prior art submerged nozzle (curve (b)) and between 40 and 50 times less than the first prior art submerged nozzle (curve (a)).

Several conclusions can be drawn from the foregoing results. First, by comparing the first and second prior art submerged nozzles (curves (a) and (b) of FIG. 11), it can be concluded that by bulging the erosion resistant sleeve by a protruding distance (a), the average friction forces can be reduced by about 35%. This solution requires using larger amounts of the second material, which is more expensive than the first material. Second, by comparing the submerged nozzle according to the present invention with the first and second prior art submerged nozzles (curve (c) with curves (a) and (b) of FIG. 11), it can be concluded that,

- by adding annular protrusions (2*p*) according to the present invention of maximum thickness equals to the protruding distance (a) to the flush erosion resistant sleeve (2) of the first prior art submerged nozzle, the average friction forces can be reduced by about 98%, and
- by removing some of the second material from the bulged erosion resistant sleeve (2) of the second prior art submerged nozzle (=curve (b)) to form annular protrusions (2*p*) according to the present invention separated from one another by recessed portions (2*r*) of diameter (Dr) equal to the diameter (D1) of the tubular portion (i.e., Dr=D1), the average friction forces can be reduced by about 97%.

With such drastic reduction of the erosion forces applied onto the outer walls thereof, the service life of a submerged nozzle according to the present invention is clearly enhanced. Lower amounts of the second material are required since erosion is slowed down.

The submerged nozzle of the present invention constitutes a breakthrough in the enhancement of the erosion issues linked to the complex flow patterns followed by liquid metal flowing out of a submerged nozzle into a mould (11). The average friction forces applied onto the outer walls of the submerged nozzle were practically eliminated. Without wishing to be bound by any theory, it is believed that the one or more protrusions prevent the continuous growing in intensity of vortices formed by the liquid metal upon colliding against the walls of the submerged nozzle, as they are flowing against and along said walls. When in a smooth surface, as in the case e.g., of the first prior art submerged nozzle of FIG. 11 (=curve (a)), the vortex formed at one point of the wall grows fed by liquid metal freely flowing from different directions. With a bulged erosion resistant sleeve (e.g., as in curve (b) of FIG. 11) the flow of liquid metal flowing from top to bottom, towards the outlets (1*o*) is deviated by the step of protruding distance (a) and cannot contribute as efficiently to the continuous growing of the vortices. It can be seen in FIG. 11, however, that after about 30 s, curves (a) and (b) merge, suggesting that this vertical flow eventually stabilizes and becomes more stationary, thus stably contributing to the growing of any vortex thus formed.

With the annular protrusions (2*p*) according to the present invention, it is believed that flows of liquid metal flowing from various directions are deviated. Because they form closed loops, they deviate a top-down vertical flow as discussed supra with respect to the bulged erosion resistant sleeve, but with their wavy geometry of amplitude (A) they also deviate liquid metal flowing against the walls (i.e., transversally to the longitudinal axis (Z)). By deviating the two main flow directions believed to be responsible for the formation and growth of vortices, the vortices remain small and isolated, and the effect on frictional forces reduction is stunningly clear as shown by comparing curve (c) with prior art curves (a) and (b) in FIG. 11.

The disruption of the main flows is also believed to reduce the amount of mould flux (22) and, in particular, of mould powder (22*p*) dragged down into the liquid metal against the submerged nozzle's walls, which reduces the amount of powder to be refilled to maintain the mould flux (22) layer stable, it reduces contamination of the metal parts, and it reduces the erosion rate of the submerged nozzle walls, since the mould powder (22*p*) is quite erosive.

This drastic reduction of erosion allows a corresponding reduction of the thickness of the erosion resistant sleeve (2) required for maintaining the required service life of a submerged nozzle. Since the second material is generally more expensive than the first material of the tubular portion (1), this results in savings in the production of metal sheets and parts.

| REF | DESCRIPTION |
|---|---|
| 1 | tubular portion |
| 1b | inner bore |
| 1i | inlet |
| 1o | outlet |
| 1p | additional annular protrusion |
| 2 | erosion resistant sleeve |

-continued

| REF | DESCRIPTION |
|---|---|
| 2p | annular protrusion |
| 2r | recessed portion |
| 11 | mould |
| 21 | molten metal |
| 21s | Shell of frozen metal |
| 22 | mould flux |
| 22m | molten mould powder |
| 22p | mould powder |
| 31 | molten metal container |
| 31o | casting outlet |
| a | protruding distance |
| b | annular protrusion width |
| d2d | distance separating a tip point of a first annular protrusion from a tip-point of a second annular protrusion |
| A | amplitude |
| D1 | diameter of the tubular portion |
| Dp | diameter of the protrusion (circular cross section) |
| DM | major axis of the recessed portion (elliptic cross-section) |
| dm | minor axis of the recessed portion (elliptic cross-section) |
| Dr | diameter of the recessed portion (circular cross-section) |
| Dra | average recess diameter (elliptic cross-section) |
| L1 | tubular portion length |
| L2 | sleeve length |
| P | Periodicity |
| Z | longitudinal axis |

The invention claimed is:

1. A submerged nozzle for casting molten metal into a mould or a tundish, the submerged nozzle comprising, a tubular portion (1) made of a first material, wherein the tubular portion, extends along a longitudinal axis (Z) over a tube length (L1) between a first end and a second end of the submerged nozzle, comprises an inner bore (1*b*) extending along the longitudinal axis (Z) from an inlet (1*i*) axially opening at or adjacent to the first end to at least one outlet (1*o*) opening at or adjacent to the second end, an erosion resistant sleeve (2) made of a second material different from, and more resistant to erosion than the first material, wherein the erosion resistant sleeve, circumscribes a whole circumference of the tubular portion, and extends along the longitudinal axis (Z) over a sleeve length (L2) lower than the tube length (L1) (i.e., L2<L1), comprises a recessed portion (2*r*) of a thinnest cross-section defined by a major axis (DM) and a minor axis (dm), wherein a ratio (dm/DM) of the minor axis to the major axis is between 0.7 to 1.0, characterized in that, the erosion resistant sleeve comprises at least one annular protrusion (2*p*), extending radially outwards beyond the recessed portion (2*r*) by a protruding distance (a) over a whole of a circumference of the erosion resistant sleeve (2), wherein the at least one annular protrusion (2*p*) follows a trajectory around the tubular portion oscillating between one or more tip-points situated closest to the first end and a corresponding number of one or more valley-points situated closest to the second end.

2. The submerged nozzle according to claim 1, wherein the trajectory is a wavy trajectory, wherein the wavy trajectory is defined by, an amplitude (A) greater than 5 mm (i.e., A>5 mm) measured along the longitudinal axis (Z) between adjacent tip-points and valley points, and a periodicity (P) defined as the number of tip-to-valley periods per 2π rad of circumference, between 1 and 20 tip-to-valley-to tip periods per 2π rad.

3. The submerged nozzle according to claim 2, wherein an amplitude ratio (A/L2) of the amplitude (A) to the sleeve length (L2) is between 2% and 100%.

4. The submerged nozzle according to claim 3, wherein the amplitude ratio (A/L2) of the amplitude (A) to the sleeve length (L2) is between 5% and 50%.

5. The submerged nozzle according to claim 2, wherein the periodic wavy trajectory is in a form of: a rounded wavy trajectory, or a chevron trajectory.

6. The submerged nozzle according to claim 5, wherein the amplitude (A) measured between adjacent tip-points and valley points of an annular protrusion (2*p*) is constant for all adjacent tip-points and valley-points of the annular protrusion (2*p*).

7. The submerged nozzle according to claim 2, wherein the trajectory is the wavy trajectory is a periodically wavy trajectory.

8. The submerged nozzle according to claim 2, wherein the periodicity (P) is between 2 and 5.

9. The submerged nozzle according to claim 1, comprising one, two, three, four, five, or more annular protrusions (2*p*) distributed along the longitudinal axis (Z), wherein in a case of two or more protrusions, the protrusions do not contact with one another.

10. The submerged nozzle according to claim 9, wherein the protrusions are identical to each other.

11. The submerged nozzle according to claim 9, wherein the protrusions are parallel to one another.

12. The submerged nozzle according to claim 1, wherein a cross-section of the one or more annular protrusions (2*p*) along a plane comprising the longitudinal axis (Z) is selected among one or more of: rounded, trapezoidal, square, and triangular.

13. The submerged nozzle according to claim 1, wherein the annular protrusion (2*p*) protrudes radially from the recessed portion (2*r*) by the protruding distance (a) such that a ratio (a/Dra) of the protruding distance (a) of the annular protrusion (2*p*) to an average recess diameter (Dra) of the recessed portion (2*r*) is between 1 and 30% , wherein the average recess diameter (Dra) is defined as an average of the major and minor axes of the recessed portion (2*r*).

14. The submerged nozzle according to claim 1, wherein the annular protrusion (2*p*) protrudes radially from the recessed portion (2*r*) by a protruding distance (a) between 5 and 50 mm.

15. The submerged nozzle according to claim 1, wherein a length ratio (L2/L1) of the sleeve length (L2) to the tube length (L1) is between 10 and 50%, and wherein at least two annular protrusions (2*p*) are distributed over the sleeve length (L2) of the erosion resistant sleeve (2).

16. The submerged nozzle according to claim 1, wherein a width (b) of an annular protrusion (2*p*) measured along the longitudinal axis (Z) is between 5 and 50 mm.

17. The submerged nozzle according to claim 1, wherein the second material comprises zirconia.

18. The submerged nozzle according to claim 1, wherein the at least one annular protrusion (2*p*) forms a closed loop around the tubular portion of the submerged nozzle.

19. A process for reducing erosion of a submerged nozzle upon continuous casting of molten metal into a mould or a tundish, the process comprising, coupling an inlet (1*i*) of a submerged nozzle to a molten metal container (31), with an outlet (1*o*) of the submerged nozzle in fluid communication with a mould (11) or a tundish, casting metal from the molten metal container into the mould or the tundish through a bore (1*b*) of the submerged nozzle, Characterized in that, the submerged nozzle is according to claim 1, with at least one annular protrusion (2*p*) being submerged below a level of slag (22) in the mould (11) or the tundish.

20. A casting installation comprising, a molten metal container (31) containing molten metal and comprising a casting outlet (31*o*), a mould (11) or a tundish provided below the casting outlet (31*o*)

a submerged nozzle comprising an inner bore (1*b*) extending along the longitudinal axis (Z) from an inlet (1*i*) axially opening at or adjacent to a first end to at least one outlet (1*o*) opening at or adjacent to a second end, wherein the submerged nozzle is coupled to the molten metal container such that the inlet (1*i*) of the submerged nozzle is in fluid communication with the casting outlet (31*o*), and such that the outlet (1*o*) of the submerged nozzle is inside the mould or the tundish, characterized in that, the submerged nozzle is according to claim 1.

* * * * *